United States Patent [19]

Altherr

[11] 3,998,337

[45] Dec. 21, 1976

[54] COUPLER DOUBLE SHELF COLLAR

[75] Inventor: Russell George Altherr, Munster, Ind.

[73] Assignee: AMSTED Industries Incorporated, Chicago, Ill.

[22] Filed: Aug. 4, 1975

[21] Appl. No.: 601,520

[52] U.S. Cl. ..... 213/153

[51] Int. Cl.[2] ..... B61G 3/00

[58] Field of Search ..... 213/100 R, 153

[56] References Cited

UNITED STATES PATENTS 3,675,787 7/1972 Krauskopf ..... 213/153

*Primary Examiner*—Allen N. Knowles
*Assistant Examiner*—Hadd Lane
*Attorney, Agent, or Firm*—Fred P. Kostka; Ralph M. Faust

[57] ABSTRACT

A collar having an upper and a lower shelf and adapted to be secured to the head of an A.A.R. Standard E-type railway coupler or other coupler not provided with safety shelves, the shelves, when the collar is so secured, lying respectively over and under the coupler head recess which receives the knuckle of a mated coupler to prevent coupler disengagement during a derailment or a coupler pull-out.

1 Claim, 3 Drawing Figures

COUPLER DOUBLE SHELF COLLAR

It has been proposed to provide railway couplers, particularly those used on tank cars, with upper and lower interlocking shelves to prevent accidental separation of mated couplers during a train wreck. In a wreck, mated couplers without such shelves could become misaligned, in a vertical direction, sufficiently so as to permit disengagement of the couplers. Such disengagement would permit a pulled-out coupler to fall to the road bed and cause a derailment. In the event of any derailment, even those without a coupler pull-out, intercoupled A.A.R. type E- and F-couplers could become misaligned sufficiently to allow the E-coupler knuckle to slip out of engagement whereat one of the now uncoupled couplers could puncture a tank car and result in an explosion or the release of noxious gas. Upper and lower interlock shelves could effectually eliminate these problems.

The expense, however, of replacing all existing couplers with double-shelf couplers would be exhorbitant.

The primary object, therefore, of the present invention is the provision of a double shelf collar arrangement which is receivable over the head of a coupler having no shelves, thereby converting such coupler to a double-shelf coupler.

A corollary object is to provide a device which will convert an A.A.R. Standard E-type coupler to a double-shelf coupler quickly and at comparatively low cost.

Another objective is to provide a device which will prevent vertical separation of any mated coupler when the device is mechanically secured to an A.A.R. Standard E-type coupler, or to a similar coupler, and that can be reused on any similar coupler.

These and other objects will become apparent from the following description and accompanying drawings wherein.

Figure 2:
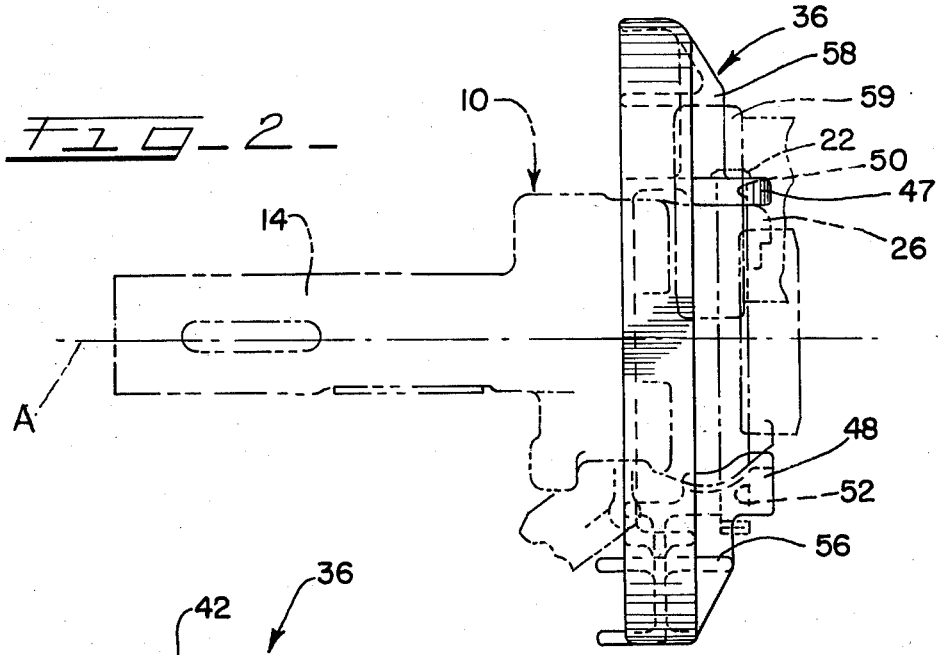
FIG. 2 is a side elevational view of the device of FIG. 1.
Figure 1:
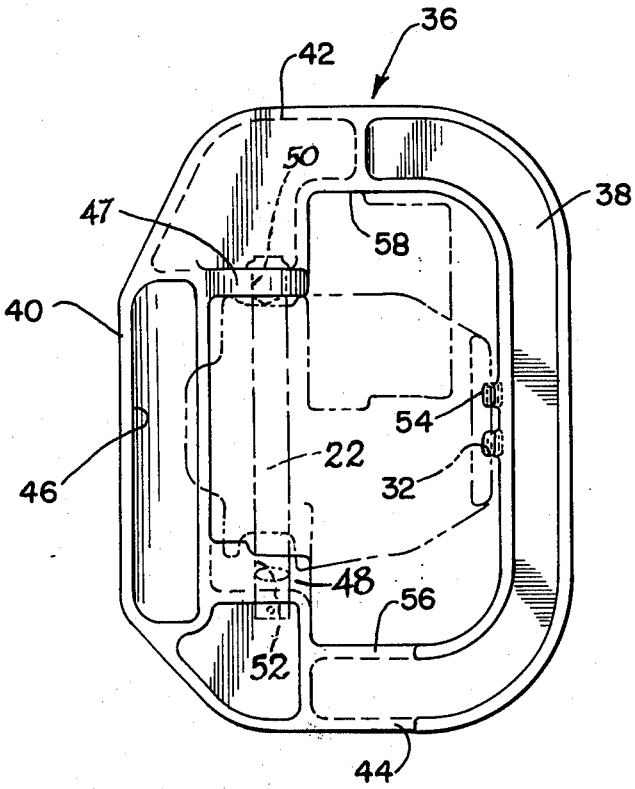
FIG. 1 is a front elevational view of a double-shelf collar, as it would be applied to an A.A.R. Standard E-type coupler, the coupler being shown in phantom lines.

Referring now to the drawings, the E type coupler 10 (shown in phantom lines) to which this invention primarily relates, includes a coupler head 12 and a shank 14 adapted to be mounted in a conventional draft gear (not shown) of a railway car.

The head 12 includes a knuckle side 16 and a guard arm side 18. A knuckle 20 is pivotally mounted for movement between open and closed positions on a pivot pin 22 received in openings 24 of aligned pivot lugs 26. A front face extends between a guard arm 30 and the pivot lugs 26 and defines therewith a knuckle recess 31 adapted to receive the knuckle of the coupler of an adjacent railway car. The guard arm 30 is conventionally provided with core slots 32 which relate to foundry practice and generally serve no function in the finished E type coupler casting.

The collar, indicated generally at 36, includes a vertically disposed guard arm leg 38 and knuckle side leg 40, the legs being interconnected by an upper strap 42 and a lower strap 44. The guard arm leg is shown as an I-section for strength and lightness while the knuckle side leg is provided with a generally V-shaped, forwardly facing, opening 46, as best seen in FIG. 3, the purpose of which will be explained hereinafter.

Forwardly projecting upper and lower pivot pin lugs 47 and 48 are provided with aligned openings 50 and 52 while the guard arm leg 38 is provided with one or more locating lugs 54. A lower horizontal shelf 56 integral with the lower strap 44 projects forwardly from the strap and is vertically aligned with an upper horizontal shelf 58 integral with and projecting forwardly of the upper strap 42, the shelves at least partially underlying and overlying, respectively, the knuckle recess 31.

The collar is assembled onto an E-type coupler by first inserting locating lugs 54 into the guard arm core slots 32 and then aligning the openings 50 and 52 of lugs 47 and 48 with the pivot pin openings 24 of pivot lugs 26. The pivot pin 22, which must be slightly longer than a conventional pivot pin, is inserted through the aligned openings and retained by means of a cotter pin. When the collar is so assembled on a coupler, the upper and lower shelves 58 and 56 overlie and underlie, respectively, the knuckle recess 31 as best seen in FIG. 3. The shelves are spaced vertically from the longitudinal centerline of the coupler a distance at least as great as the height of the coupler knuckle but not greater than the distance at which the knuckle would fail to couple with another coupler knuckle resting on the lower shelf of the collar. A typical mating knuckle is shown in phantom lines at 59 in FIG. 3 and is shown in FIG. 2 in its maximum upward position. It is apparent that the collar shelves, as shown in the drawings, are spaced from the longitudinal axis A of the coupler so that they will not interfere with the normal movement of mated couplers as required by A.A.R. specifications.

Figure 3:
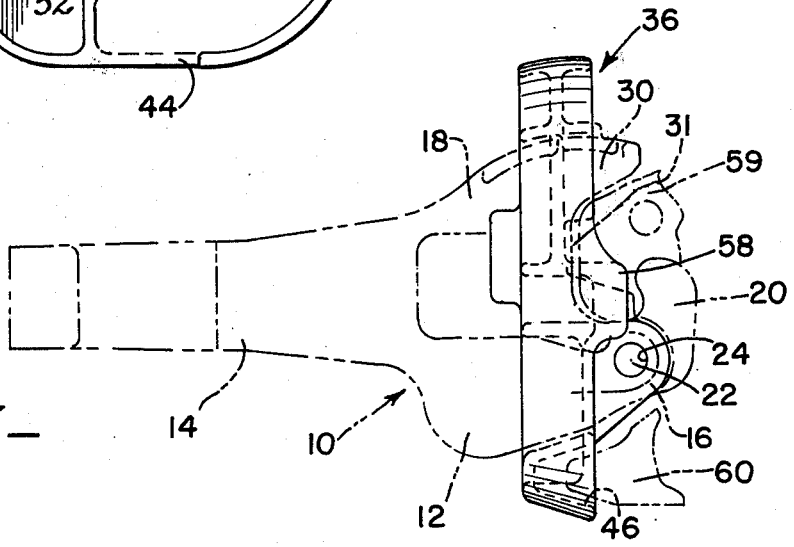
FIG. 3 is a top plan view of the device of FIG. 1.

The lower strap 44 and lower shelf 56 must also be constructed to clear the conventional auxiliary interlocking lug of a mating A.A.R. standard F type coupler while the forwardly facing V-shaped opening 46 is arranged to accommodate, as seen in FIG. 3, the guard arm nose 60 of such mating F type coupler.

It is seen, therefore, that the double shelf collar, when assembled on an E type coupler or on a similar coupler not normally provided with upper or lower shelves, will provide protection against vertical slip-over of a mating coupler knuckle and will also support a mating coupler after a pull-out. It should be understood that the described arrangement is the preferred embodiment and that many modifications may be made without departing from the spirit of the invention.

What is claimed is:

1. A collar adapted to be secured to the head of a noninterlocking type E railway car coupler including a head, a knuckle pivotally mounted in pivot lugs having aligned openings to receive a pivot pin, and a guard arm, the pivot lugs and guard arm defining a recess adapted to receive the knuckle of a mating coupler, said collar comprising a unitary rigid structure having a guard arm leg and a knuckle side leg interconnected by upper and lower straps, a shelf on said upper strap extending above the head and at least partially overlying said recess, a shelf on said lower strap extending below the head and at least partially underlying said recess, and a forwardly extending opening in the knuckle side leg adapted to receive the guard arm nose of a mating A.A.R. F type coupler, said collar being capable of resisting a full vertical load transmitted by a mating coupler.

* * * * *